US008616113B2

(12) United States Patent
Gallo et al.

(10) Patent No.: US 8,616,113 B2
(45) Date of Patent: Dec. 31, 2013

(54) ENCAPSULATED BALLISTIC PROTECTION SYSTEM

(75) Inventors: Michael J. Gallo, San Bernardino, CA (US); William Burley, East Greenwich, RI (US)

(73) Assignee: Kelly Space & Technology, Inc., San Bernardino, CA (US)

( * ) Notice: Subject to any disclaimer, the term of this patent is extended or adjusted under 35 U.S.C. 154(b) by 950 days.

(21) Appl. No.: 12/544,193

(22) Filed: Aug. 19, 2009

(65) Prior Publication Data

US 2012/0174759 A1 Jul. 12, 2012

Related U.S. Application Data

(60) Provisional application No. 61/090,196, filed on Aug. 19, 2008, provisional application No. 61/095,908, filed on Sep. 10, 2008.

(51) Int. Cl.
*F41H 5/04* (2006.01)

(52) U.S. Cl.
USPC ..... 89/36.02; 89/903; 89/914; 89/917; 89/921

(58) Field of Classification Search
USPC ..... 89/36.02, 36.05; 428/911
See application file for complete search history.

(56) References Cited

U.S. PATENT DOCUMENTS

| | | | | |
|---|---|---|---|---|
| 1,463,498 | A * | 7/1923 | Burgess | 109/81 |
| 3,874,855 | A * | 4/1975 | Legrand | 428/550 |
| 4,364,300 | A * | 12/1982 | Pagano et al. | 89/36.02 |
| 5,206,451 | A * | 4/1993 | Bocker | 89/36.02 |
| 5,577,432 | A * | 11/1996 | Becker et al. | 89/36.17 |
| 6,895,851 | B1 * | 5/2005 | Adams et al. | 89/36.02 |
| 7,549,366 | B2 * | 6/2009 | Park et al. | 89/36.02 |
| 7,827,899 | B2 * | 11/2010 | Ravid et al. | 89/36.05 |
| 2007/0089596 | A1 * | 4/2007 | Huber et al. | 89/36.02 |
| 2008/0264244 | A1 * | 10/2008 | Ravid et al. | 89/36.02 |
| 2009/0145288 | A1 * | 6/2009 | Thurau et al. | 89/36.02 |
| 2009/0214812 | A1 * | 8/2009 | Bartus et al. | 428/68 |

* cited by examiner

*Primary Examiner* — Bret Hayes
(74) *Attorney, Agent, or Firm* — Christie, Parker & Hale, LLP

(57) ABSTRACT

An encapsulated ballistic protection system (EBPS). In one embodiment, an EBPS for protecting a human or an object from a projectile includes one or more ballistic protection material layers at least substantially encapsulated by encapsulation material having a tensile strength of 20,000 psi or greater. Additionally, in one embodiment, an EBPS includes one or more ballistic protection material layers that are substantially encapsulated by the encapsulation material on a first side adapted to face the human or the object and on a second side opposite the first side and adapted to face the projectile, and the EBPS further includes a compressible layer between the one or more ballistic protection material layers and the encapsulation material on the first side, the compressible layer configured to at least one of dissipate energy, reduce velocity of the projectile, and reduce backface deformation.

31 Claims, 4 Drawing Sheets

ENCAPSULATED BALLISTIC PROTECTION SYSTEM

CROSS-REFERENCE TO RELATED APPLICATIONS

This application claims priority to and the benefit of each of U.S. Provisional Application No. 61/090,196, filed on Aug. 19, 2008, and U.S. Provisional Application No. 61/095,908, filed on Sep. 10, 2008, the entire content of each of which is incorporated herein by reference.

FIELD OF THE INVENTION

The present invention relates generally to ballistic protection systems, and more particularly to an encapsulated ballistic protection system.

BACKGROUND

Firearm ballistic resistive armor dates back to the late 1500s and consisted of metallic armor that was malleable enough to dissipate energy without allowing penetration. The first "soft" ballistic armor known was invented in Korea in the 1860s, which was formed into vests made of 30 folds of cotton. During the early 1880s, silk vests resembling medieval padded jackets were used that consisted of 18 to 30 layers of cloth to stop the relatively slow rounds from black powder handguns.

During World War I, the United States developed several types of body armor, including a chrome nickel steel breastplate and a headpiece that could withstand Lewis Gun bullets at 2,700 feet per second, but was clumsy and heavy at 40 pounds. A scaled waistcoat of overlapping steel scales fixed to a leather lining was also designed. This armor weighed 11 pounds, fit close to the body, and was considered more comfortable. During the late 1920s through the early 1930s, gunmen from criminal gangs in the United States began wearing less-expensive vests made from thick layers of cotton padding and cloth. These early vests could absorb the impact of handgun rounds, such as 0.22, 0.25, S&W 0.32 Long, S&W 0.32, 0.380 ACP, and 0.45 ACP, traveling at slower speeds of up to approximately 1,000 feet per second. To overcome these vests, law enforcement agents, such as those of the FBI, began using the new, more powerful 0.357 Magnum cartridge.

In the early stages of World War II, the United States designed body armor for infantrymen, but most models were heavy and significantly restricted mobility. Additionally, these armor vests were often incompatible with existing equipment. The military diverted its research efforts to developing "flak jackets" for aircraft crews. These flak jackets were made of nylon fabric and capable of stopping flak and shrapnel, but not designed to stop bullets. The Red Army used several types of body armor that consisted of two pressed steel plates that protected the front torso and groin. The plates were 2 mm thick and weighed 7.7 pounds. The United States developed a vest using Doron Plate, a fiberglass-based laminate that was first used by the United States in the Battle of Okinawa in 1945.

During the Korean War, several new vests were produced for the United States military, which made use of fiberglass or aluminum segments woven into a nylon vest, although these vests were not considered very effective. Vietnam War era vests were not simply updated versions of the Korean models but began use of rifle bullet stopping ceramic plates. Vests for aircrews were the first to use ceramic-metal composites, such as boron carbide, silicon carbide, and aluminum oxide, and were capable of stopping rifle fire while giving a very large area of coverage to its wearer.

In the mid-1970s, KEVLAR synthetic fiber was introduced, which was woven into a fabric and layered. KEVLAR is a registered U.S. trademark owned by E. I. du Pont de Nemours and Company (Wilmington, Del.). Immediately, KEVLAR was incorporated into a National Institute of Justice (NIJ) evaluation program to provide lightweight, concealable body armor to ascertain if everyday concealable wearing was possible. It was quickly determined that KEVLAR body armor could be comfortably worn by police daily, and would save lives. In 1975, American Body Armor marketed an all-KEVLAR vest called the K-15, comprised of 15 layers of KEVLAR that also included a 5-inch by 8-inch ballistic steel "Shok Plate" positioned vertically over the heart and was issued U.S. Pat. No. 3,971,072 for this ballistic vest innovation. Similarly sized and positioned "trauma plates" are still used today on the front ballistic panels of most concealable vests, reducing blunt trauma and increasing ballistic protection in the center-mass heart/sternum area.

Since the 1970s, several new fibers and construction methods for bulletproof fabric have been developed besides woven KEVLAR, such as DSM's DYNEEMA, Honeywell's GOLD FLEX and SPECTRA, Teijin's TWARON, Pinnacle Armor's DRAGON SKIN, and Toyobo's ZYLON (now controversial, as new studies report that it degrades rapidly, leaving wearers with significantly less protection than expected). DYNEEMA is a registered U.S. trademark owned by DSM High Performance Fibers B.V. (Netherlands). GOLD FLEX and SPECTRA are registered U.S. trademarks owned by Honeywell International Inc. (Morristown, N.J.). TWARON is a registered U.S. trademark owned by Teijin Aramid B.V. (Netherlands). DRAGON SKIN is a registered U.S. trademark owned by Pinnacle Armor, LLC (Fresno, Calif.). ZYLON is a registered U.S. trademark owned by Toyo Boseki Kabushiki Kaisha, Ta Toyobo Co., Ltd. (Japan). These newer materials are advertised as being lighter, thinner, and more resistant than KEVLAR, although they are much more expensive.

Currently, typical body armor, such as the United States Army's Improved Outer Tactical Vest and United States Marine Corps's Modular Tactical Vest, consists of textile vests augmented with metal (e.g., steel or titanium), ceramic, or polyethylene plates that provide extra protection to vital areas of the body and have become standard for military use. These hard armor plates have proven effective against handguns and a range of rifles. Soft body armor vests consist of layers of very strong fibers that catch and deform soft bullets and spread their force over a larger portion of the vest fiber. In the process, the vest absorbs the energy from the bullet, bringing it to a stop before it can penetrate the vest. A deformable handgun bullet mushrooms into a dished plate on impact with a well-designed textile vest. Some layers of the vest may be penetrated, but as the bullet deforms, the energy is absorbed by a larger and larger fiber area. While a vest can prevent bullet penetration, the vest and wearer still absorb the bullet's energy. Even without penetration, modern pistol bullets contain enough energy to cause blunt force trauma under the impact point. Vest specifications include both penetration resistance requirements and limits on the amount of impact energy that is delivered to the body.

Vests designed for bullets offer little protection against stabbing knife blows, arrows, ice picks, and bullets manufactured of non-deformable materials (i.e. steel core instead of lead). As the force is concentrated in a relatively small area with bladed weapons and non-deformable rounds, they can push and cut through the fiber layers of most bullet-resistant fabrics. Specially-designed vests which protect against bladed weapons and sharp objects are often used in vests for corrections officers and other law enforcement officers. Some materials, such as coated and laminated para-aramid textile, offer considerable protection against bladed weapons and slash attacks. More advanced protection for knives makes use of metallic vest components.

Rifle resistant armor is predominantly of two basic types: ceramic plate-based systems, and hard fiber-based laminate systems. Many rifle armor components contain both hard ceramic components and laminated textile materials used together. Various ceramic materials are in use; however, aluminum oxide, boron carbide, and silicon carbide are the most common. The fibers used in these systems are the same as found in soft textile armor. However, for rifle protection, high pressure lamination of ultra-high molecular weight polyethylene with a KRATON matrix is the most common. KRATON is a registered U.S. trademark owned by Kraton Polymers (Houston, Tex.). The Small Arms Protective Insert (SAPI) and the enhanced SAPI plate for the U.S. Department of Defense (DoD) Interceptor Body Armor generally has this form. Because of the use of ceramic plates for rifle protection, these vests are five to eight times heavier on an area basis than vests for handgun protection. The weight and stiffness of rifle armor is a major technical challenge. The density, hardness, and impact toughness are among the materials properties that are balanced to design these systems. While ceramic materials have some outstanding properties for ballistics, they are not strong under tensile loads. Failure of ceramic plates by cracking must also be controlled. For this reason, many ceramic rifle plates are a composite. The strike face is ceramic with the backface formed of laminated fiber and resin materials. The hardness of the ceramic prevents the penetration of the bullet, while the tensile strength of the fiber backing helps prevent tensile failure.

For defense against more substantial threats, such as from higher caliber weapons, cannons, and other larger projectiles, armor has predominantly consisted of dense metallic and ceramic materials that resist impact loads through sheer density of the impact surface. For these applications, heavy armor panels are applied parasitically, in that they are externally applied to the surface area to be protected. These heavy armor applications possess the key disadvantage of significant added weight, and can also create additional collateral damage if penetrated and compromised by becoming projectiles themselves.

In addition to static armor systems, there is a type of armor known as "Reactive Armor" that reacts in some way to the impact of a weapon to reduce the damage done to the object being protected. It is most effective in protecting against shaped charges and long rod penetrators. The most common type is Explosive Reactive Armor (ERA), which typically consists of a sheet or slab of high explosive sandwiched between two plates, typically metal, called the reactive or dynamic elements. On attack by a penetrating weapon, the explosive detonates, forcibly driving the metal plates apart to damage the penetrator. Variants include Self-Limiting Explosive Reactive Armor (SLERA), Non-Energetic Reactive Armor (NERA), Non-Explosive Reactive Armor (NxRA), and Electric Reactive Armor. Unlike ERA and SLERA, NERA and NxRA modules can withstand multiple hits, but a second hit in exactly the same location will still penetrate.

National Institute of Justice (NIJ) Standard-0101.06 and NIJ Standard-0108.01 classifies body armor and vehicle armor into seven different threat levels consisting of, in order from lowest to highest level of protection: Type I, Type IIA, Type II, Type IIIA, Type III, Type IV, and Special. Each of these armor protection levels is described generally below.

Type I (22 LR; 380 ACP) armor protects against .22 caliber Long Rifle Lead Round Nose (LR LRN) bullets, with nominal masses of 2.6 g (40 gr) impacting at a minimum velocity of 320 m/s (1050 ft/s) or less, and 380 ACP Full Metal Jacketed Round Nose (FMJ RN) bullets, with nominal masses of 6.2 g (95 gr) impacting at a minimum velocity of 312 m/s (1025 ft/s) or less.

Type IIA (9 mm; 40 S&W) armor protects against 9 mm Full Metal Jacketed Round Nose (FMJ RN) bullets, with nominal masses of 8.0 g (124 gr) impacting at a minimum velocity of 332 m/s (1090 ft/s) or less, and 40 S&W caliber Full Metal Jacketed (FMJ) bullets, with nominal masses of 11.7 g (180 gr) impacting at a minimum velocity of 312 m/s (1025 ft/s) or less. It also provides protection against the threats described above with respect to Type I armor.

Type II (9 mm; 357 Magnum) armor protects against 9 mm Full Metal Jacketed Round Nose (FMJ RN) bullets, with nominal masses of 8.0 g (124 gr) impacting at a minimum velocity of 358 m/s (1175 ft/s) or less, and 357 Magnum Jacketed Soft Point (JSP) bullets, with nominal masses of 10.2 g (158 gr) impacting at a minimum velocity of 427 m/s (1400 ft/s) or less. It also provides protection against the threats described above with respect to Type I and Type IIA armor.

Type IIIA (High Velocity 9 mm; 44 Magnum) armor protects against 9 mm Full Metal Jacketed Round Nose (FMJ RN) bullets, with nominal masses of 8.0 g (124 gr) impacting at a minimum velocity of 427 m/s (1400 ft/s) or less, and 44 Magnum Semi Jacketed Hollow Point (SJHP) bullets, with nominal masses of 15.6 g (240 gr) impacting at a minimum velocity of 427 m/s (1400 ft/s) or less. It also provides protection against most handgun threats, as well as the threats described above with respect to Type I, Type IIA, and Type II armor.

Type III (Rifles) armor protects against 7.62 mm Full Metal Jacketed (FMJ) bullets (U.S. Military designation M80), with nominal masses of 9.6 g (148 gr) impacting at a minimum velocity of 838 m/s (2750 ft/s) or less. It also provides protection against the threats described above with respect to Type I, Type IIA, Type II, and Type IIIA armor.

Type IV (Armor Piercing Rifle) armor protects against .30 caliber armor piercing (AP) bullets (U.S. Military designation M2 AP), with nominal masses of 10.8 g (166 gr) impacting at a minimum velocity of 869 m/s (2850 ft/s) or less. It also provides at least single hit protection against the threats described above with respect to Type I, Type IIA, Type II, Type IIIA, and Type III armor.

Special Type armor protects against threat levels other than one of the above standard types. A purchaser having a special requirement for a level of protection other than one of the above standard types and threat levels should specify the exact test round(s) and minimum reference impact velocities to be used, and indicate that this standard shall govern in all other aspects.

In addition to NIJ standards, military ballistic protection requirements are defined in MIL-STD-662F which provides general guidelines for procedures, equipment, physical conditions, and terminology for determining the ballistic resistance of metallic, nonmetallic, and composite armor against small arms projectiles. Other standards include, but are not limited to, MIL-STD-2105C, Hazard Assessment Tests for Non-nuclear Munitions; MIL-PRF-46103E, Performance Specification Armor Lightweight Composite; NATO AEP-55 STANAG 4569, Protection Levels for Occupants of Logistic and Light Armor Vehicles; and MIL-STD-810G, DOD Test Method Standard Environmental Engineering Considerations and Laboratory Tests.

Testing protocols provide that textile armor is tested for both penetration resistance by bullets and for the impact energy transmitted to the wearer. The "backface signature" or transmitted impact energy is measured by shooting armor mounted in front of a backing material, typically sculpture modeling oil-clay. The clay is used at a controlled temperature and verified for impact flow before testing. After the armor is impacted with the test bullet, the vest is removed from the clay and the depth of the indentation in the clay is measured.

The backface signature allowed by different test standards can be difficult to compare. Both the clay materials and the bullets used for the test are not common. However, in general, the U.K., German, and other European standards allow 20-25 mm of backface signature while the U.S.-NIJ standards allow for 44 mm, which can potentially cause internal injury. The allowable backface signature for body armor has been controversial since its introduction in the first NIJ test standard, and the debate as to the relative importance of penetration-resistance versus backface signature continues in the medical and testing communities.

In general, a vest's textile material temporarily degrades when wet. Neutral water at room temperature does not affect para-aramid or ultra-high molecular weight polyethylene (UHMWPE), but acidic, basic, and some other solutions can permanently reduce para-aramid fiber tensile strength. Because of this, the major test standards call for wet testing of textile armor. Mechanisms for this wet loss of performance are not known. Vests tested after ISO-type water immersion tend to have heat-sealed enclosures and those tested under NIJ-type water spray methods tend to have water-resistant enclosures.

Some existing armor systems encase the armor solution using methods ranging from simply applying coatings as a vapor barrier to fiberglass wrapping to serve as environmental protection and abrasion resistance, but not for the express purpose of enhancing the structural integrity of the armor system. Some of these systems on the commercial market include, but are not limited to, the following products. Tencate Advanced Armor, also known as (TCAA), uses a fiberglass and S-Glass matrix to form an outer encasement to provide an abrasive resistant and hardened enclosure for the armor system. Texstars ARMORsmith armor uses an aramid fiber "spall liner" as a form of encapsulation. This layer is designed to reduce or contain the fragments of the inner materials upon a ballistic impact. Another such system is manufactured by ArmorStruxx and incorporates the use of composite armor with an aluminum cladding on the exterior to provide a complete system for building larger structures. Safari Land uses a Cordura nylon to encapsulate body armor panels into a protected panel system that is impervious to water and bio-hazards, and provides a degree of abrasion and penetration resistance.

SUMMARY OF THE INVENTION

Aspects of embodiments of the present invention are directed to an encapsulated ballistic protection system (EBPS) that combines advantages of dense armor material compositions with the ballistic retention, reflection, and energy dissipation characteristics of fibrous materials, and which may further embody some of the behavioral characteristics of Reactive Armor. Further aspects of embodiments of an EBPS according to the present invention incorporate characteristics of the encapsulation material that enables it to serve as a structural retention layer to constrain the encapsulated ballistic protection material in order to reduce expansion beyond the boundaries of the encapsulation layer, which enhances the overall ballistic performance capability. Additional aspects of embodiments of the present invention include a unique encapsulated and layered component configuration adapted for providing significantly enhanced ballistic resistance performance, weight advantage, and reduction in backface signature over typical armor solutions.

Embodiments of an EBPS according to the present invention can be easily tailored to meet virtually any application and/or threat level. Further, embodiments of an EBPS according to the present invention are adapted to disburse projectile impact loads over large surface areas, resulting in lower impact loads on the protected surface and reduced backface signature. Further, embodiments of an EBPS according to the present invention enable the integration of structure and armor to create "structural armor" and can be formed and/or molded into virtually any shape or configuration to ensure complete armor coverage with enhanced mobility and flexibility for ease of movement. Additional aspects of embodiments of an EBPS according to the present invention are ease of incorporation of flammability and smoke resistance in accordance with ASTM E84, as well as decreased thickness compared to typical equivalently performing armor configurations. Additionally, embodiments of an EBPS according to the present invention enable the incorporation of one or more sensor systems to detect, measure, assess, and/or report impact loads on the EBPS, integrity breach to the EBPS, and/or a physical location of the EBPS.

According to one embodiment, an EBPS for protecting a human or an object from a projectile includes one or more ballistic protection material layers at least substantially encapsulated by encapsulation material having a tensile strength of 20,000 psi or greater.

In one embodiment, the one or more ballistic protection material layers are substantially encapsulated by the encapsulation material on a first side adapted to face the human or the object and on a second side opposite the first side and adapted to face the projectile, and the EBPS further includes a compressible layer between the one or more ballistic protection material layers and the encapsulation material on the first side, the compressible layer configured to at least one of dissipate energy, reduce velocity of the projectile, and reduce backface deformation. The compressible layer may include at least one material selected from the group consisting of hard board foams, honeycomb materials, and rubber compounds.

The encapsulation material may include one or more encapsulation layers. In one embodiment, the one or more ballistic protection material layers include a strike face configured to resist the projectile; a fragmentation resistance layer adjacent the strike face and configured to resist fragmentation of the strike face and retain the strike face and the projectile; and a liner encasing at least the strike face and configured to retain and resist fragmentation of the strike face, the encapsulation material includes a first encapsulation layer on the first side of the one or more ballistic protection material layers, and a second encapsulation layer on the second side of the one or more ballistic protection material layers, the fragmentation resistance layer is between the first encapsulation layer and the strike face, and the first and second encapsulation layers are integrated with each other and together encapsulate the one or more ballistic protection material layers.

In one embodiment, the encapsulation material includes at least one material selected from the group consisting of carbon-carbon, carbon-KEVLAR, KEVLAR, carbon-TWARON, TWARON, carbon-SPECTRA, carbon-S-Glass, carbon E-Glass, and fiberglass. In one embodiment, the first encapsulation layer includes a different material than the second encapsulation layer. The first encapsulation layer may have a different thickness than the second encapsulation layer.

In one embodiment, the fragmentation resistance layer is a first fragmentation resistance layer, and the EBPS further includes a second fragmentation resistance layer between the second encapsulation layer and the strike face, the second fragmentation resistance layer is configured to resist fragmentation of the strike face and retain the strike face and the projectile, and the strike face is sandwiched between the first and second fragmentation resistance layers.

In one embodiment, the first encapsulation layer includes a first foam member configured to at least one of dissipate energy, reduce velocity of the projectile, and reduce backface deformation. In one embodiment, the fragmentation resistance layer is deformable against at least one of the compressible layer and the first foam member for at least one of dissipating energy, reducing velocity of the projectile, and reducing backface deformation. In one embodiment, the first encapsulation layer further includes a first thermal barrier between the first foam member and the one or more ballistic protection material layers, and a first outer skin on a side of the first foam member opposite the first thermal barrier. In one embodiment, the second encapsulation layer includes a second foam member, a second thermal barrier between the second foam layer and the one or more ballistic protection material layers, and a second outer skin on a side of the second foam member opposite the second thermal barrier.

In one embodiment, the strike face includes at least one material selected from the group consisting of aluminum oxide, boron carbide, silicon carbide, and other hardened composites. In one embodiment, the strike face includes a plurality of tiles and at least one of a thermoplastic film or a bonding agent between and joining tiles of the plurality of tiles to one another.

In one embodiment, the strike face is configured to protect the human or the object from at least one of the group consisting of a stabbing knife blow, an arrow, an ice pick, a non-deformable bullet, and other sharp objects.

The liner may include at least one material selected from the group consisting of a rubber, a thermoplastic material, a fibrous material, a resin, and a glue. In one embodiment, the liner encases the strike face and the fragmentation resistance layer. In one embodiment, the fragmentation resistance layer includes a woven fibrous material.

In one embodiment, an EBPS further includes at least one sensor of the group of sensors consisting of: sensors adapted to at least one of detect, measure, assess, and report at least one of an impact of the projectile on the EBPS, an integrity breach to the EBPS, and a physical location of the EBPS; biological life signature sensors for monitoring health of the human; chemical-biological-nuclear detection sensors; and sensors adapted to at least one of characterize and report a status of the EBPS.

In one embodiment, an EBPS further includes at least one structural member at least partially embedded in the encapsulation material. Further, an EBPS may include at least one structural member formed from the encapsulation material.

The one or more ballistic protection material layers may be completely encapsulated by the encapsulation material.

In one embodiment, the encapsulation material has one or more pressure relief points for at least one of releasing pressure and reducing pressure build-up in the EBPS.

According to another embodiment, an EBPS for protecting a human or an object from a projectile includes a first encapsulation layer adapted to be on a side of the EBPS proximate a source of the projectile and including a first outer skin, a first thermal barrier, and a first foam member between the first outer skin and the first thermal barrier; a second encapsulation layer adapted to be on a side of the EBPS opposite the first encapsulation layer and proximate the human or the object and including a second outer skin, a second thermal barrier, and a second foam member between the second outer skin and the second thermal barrier; and a ballistic protection material layer between the first and second encapsulation layers and contacting the first and second thermal barriers, the ballistic protection material layer including: a strike face configured to resist the projectile; a first fragmentation resistance layer configured to resist fragmentation of the strike face and retain the strike face and the projectile; a second fragmentation resistance layer configured to resist fragmentation of the strike face and retain the strike face and the projectile; and a liner encasing at least the strike face and configured to retain and resist fragmentation of the strike face, wherein the strike face is sandwiched between the first and second fragmentation resistance layers.

In one embodiment, an EBPS further includes a compressible layer between the first encapsulation layer and the ballistic protection material layer and configured to at least one of dissipate energy, reduce velocity of the projectile, and reduce backface deformation.

In one embodiment, an EBPS further includes at least one structural member at least partially embedded in at least one of the first and second encapsulation layers. In one embodiment, an EBPS further includes at least one structural member formed from material of at least one of the first and second encapsulation layers.

The first and second encapsulation layers may be integrated with each other and together encapsulate the ballistic protection material layer.

In one embodiment, at least one of the first and second encapsulation layers has a tensile strength of 20,000 psi or greater.

In one embodiment, at least one of the first and second encapsulation layers includes at least one material selected from the group consisting of carbon-carbon, carbon-KEVLAR, KEVLAR, carbon-TWARON, TWARON, carbon-SPECTRA, carbon-S-Glass, carbon E-Glass, and fiberglass.

In one embodiment, at least one of the first and second encapsulation layers has one or more pressure relief points for at least one of releasing pressure and reducing pressure build-up in the EBPS.

Other features and advantages of embodiments of the present invention will become apparent from the following detailed description, taken in conjunction with the accompanying drawings which illustrate, by way of example, the features of the present invention.

DETAILED DESCRIPTION

In the following detailed description, certain exemplary embodiments of the present invention are shown and described, by way of exemplary embodiments. As those skilled in the art would recognize, the described exemplary embodiments may be modified in various ways without departing from the spirit and scope of the present invention. Accordingly, the drawings and description are to be regarded as illustrative in nature, rather than restrictive.

As used herein with respect to embodiments of the present invention, the term "encapsulated" refers to the complete covering of all surfaces of an object, material, or group of materials by one or more "encapsulating" or "encapsulation" materials and/or layers.

Embodiments of an encapsulated ballistic protection system (EBPS) according to the present invention include a layered system defining a panel or structure composed of a variety of materials arranged in an order to provide ballistic resistance and protection. In some embodiments, an EBPS according to the present invention may not contain every element layer for all ballistic protection applications, as the specific layered solution is dependent upon the threat level and ballistic protection requirements desired. As such, variously configured embodiments of an EBPS of the present invention can meet or exceed virtually all levels of protection, including those established by the National Institute of Justice (NIJ). Embodiments of the EBPS are adjustable in the layering configuration to match or exceed the defined protection level(s) and associated performance requirements.

Figure 1:
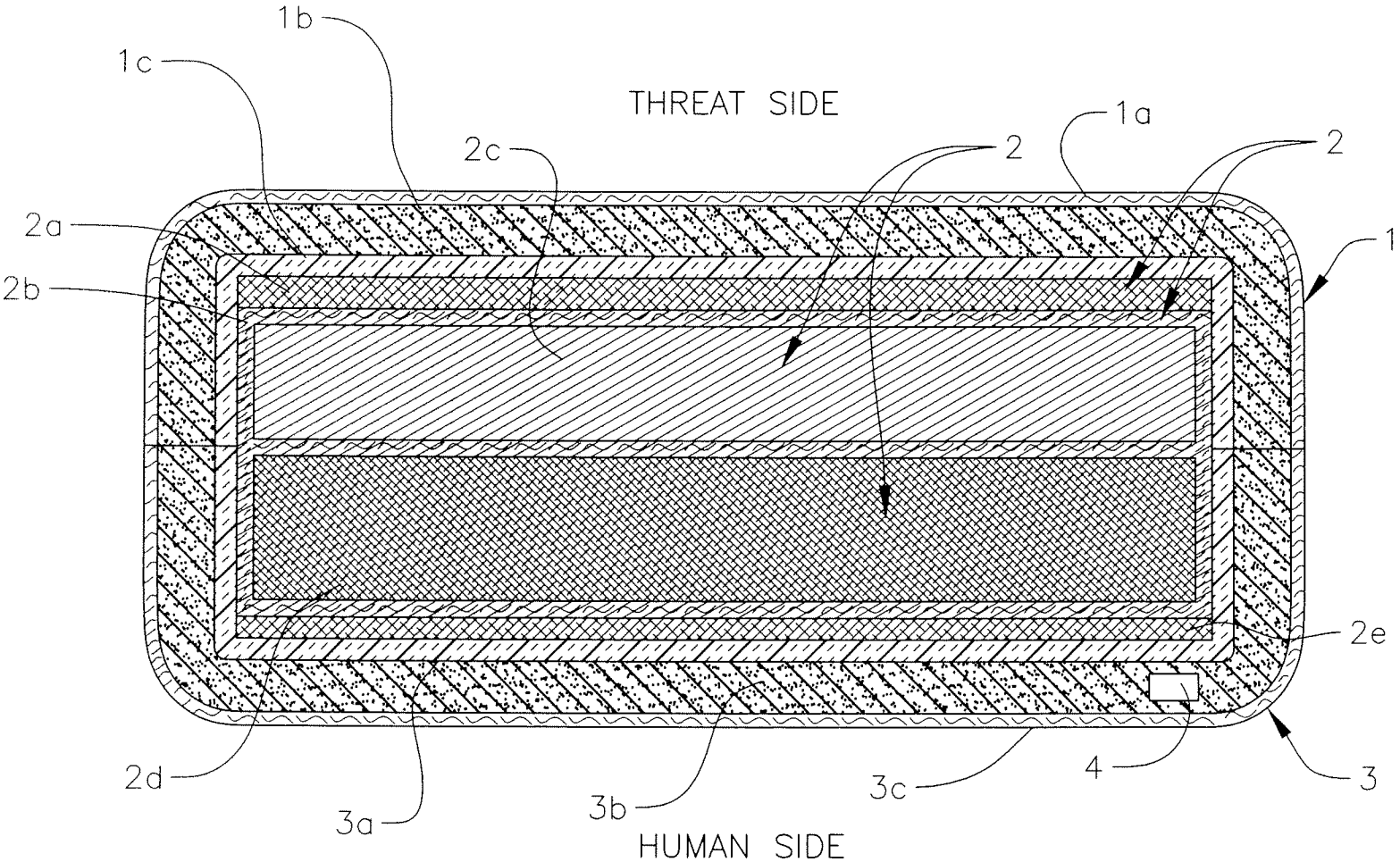
FIG. 1 is a schematic cross-sectional view of an encapsulated ballistic protection system according to an embodiment of the present invention.

With reference to FIG. 1, an EBPS according to an exemplary embodiment of the present invention includes three layered components including a threat side encapsulation layer 1, a ballistic protection material layer 2, and a human side encapsulation layer 3. The threat side encapsulation layer 1 is adapted and configured to be located on a side of the ballistic protection material layer 2 proximate a source of a projectile, while the human side encapsulation layer 3 is adapted and configured to be located on a side of the ballistic protection material layer 2 opposite the threat side encapsulation layer 1, that is, a side proximate a human or object to be protected. In an exemplary embodiment, the ballistic protection material layer 2 is encapsulated on all sides either by the threat side encapsulation layer 1 and/or the human side encapsulation layer 3. That is, the ballistic protection material layer 2 is completely encapsulated, or encased, on all sides, as shown in FIG. 1, so that ballistic protection material of the ballistic protection material layer 2 is retained and not blown out through a side of the EBPS by the force of the projectile. In an exemplary embodiment, the threat side encapsulation layer 1 and the human side encapsulation layer 3 are integrated through overlap joints (not shown) and/or bonding to create a structurally integral encapsulation around the ballistic protection material layer 2. Further, although the threat side encapsulation layer 1 and the human side encapsulation layer 3 are described and shown herein as separate components integrated together, such as through overlap joints and/or bonding, the threat side encapsulation layer 1 and the human side encapsulation layer 3, in one embodiment, may consist of a single uninterrupted layer encapsulating the ballistic protection material layer 2. In another embodiment, the threat side encapsulation layer 1 and the human side encapsulation layer 3 may be integrated, overlapped, and/or bonded with a separate encapsulation layer encasing the outer edges or sides of the EBPS for additional structural retention of the ballistic protection material layer 2, to create a structurally integral encapsulation layer around the ballistic protection material layer 2. Further, the threat side encapsulation layer 1 and the human side encapsulation layer 3 may have different thicknesses from one another and/or be formed of different materials. In exemplary embodiments, the encapsulation layer also functions as a structural layer. In one exemplary embodiment, the encapsulation layer has a tensile strength of at least 20,000 pounds per square inch (psi). In this regard, the EBPS may be used as a load bearing structural component.

Figure 2:
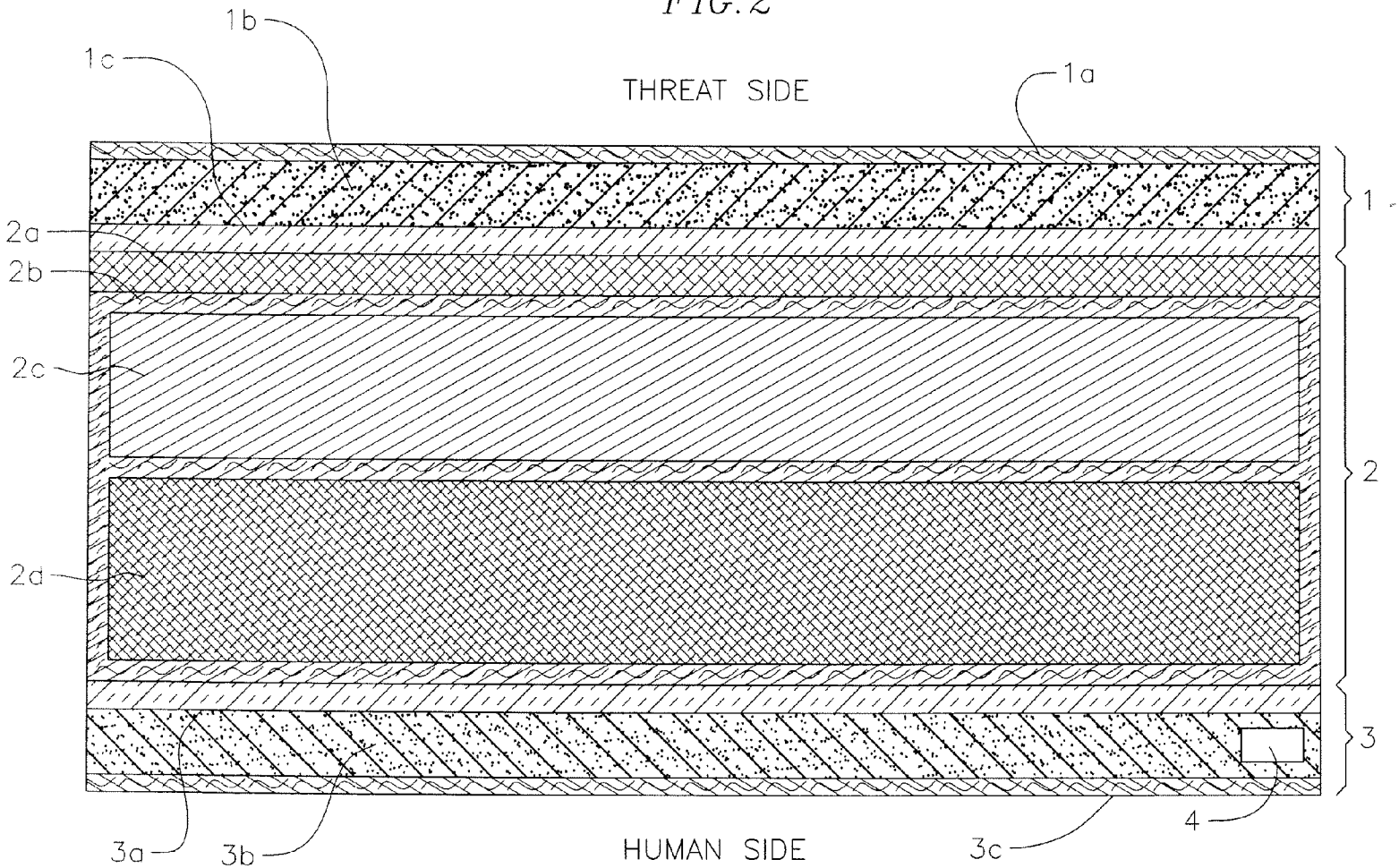
FIG. 2 is a schematic cross-sectional view of an encapsulated ballistic protection system according to another embodiment of the present invention.

With reference to FIG. 2, according to another embodiment of an EBPS according to the present invention, the ballistic protection material layer 2 may be sandwiched between the threat side encapsulation layer 1 and the human side encapsulation layer 3, but not completely encapsulated on all sides. Further, in other embodiments of an EBPS of the present invention, the ballistic protection material layer 2 may be encapsulated by only a paint or resin coating, or by one or more sublayers of one or both of the threat side encapsulation layer 1 and the human side encapsulation layer 3, rather than by all sublayers of each of the threat side encapsulation layer 1 and the human side encapsulation layer 3. For example, the degree of encapsulation of the ballistic protection material layer 2 may be chosen depending on an anticipated threat level, such as the EBPS of FIG. 1 for larger ballistics applications, or the EBPS of FIG. 2 for smaller ballistics applications.

In one exemplary embodiment, the threat side encapsulation layer 1 includes sublayers including a skin 1*a* at an outermost region of the EBPS (i.e. a portion of the EBPS nearest the source of the projectile), a foam member 1*b* adjacent the skin 1*a*, and a thermal barrier 1*c* between the foam member 1*b* and the ballistic protection material layer 2. Further, in one exemplary embodiment, the ballistic protection material layer 2 includes sublayers including one or more threat side fragmentation resistance layers 2*a* proximate the threat side encapsulation layer 1, a liner 2*b*, a strike face 2*c*, and one or more human side fragmentation resistance layers 2*d* proximate the human side encapsulation layer 3. The strike face 2*c*, in an exemplary embodiment, is, between the one or more threat side fragmentation resistance layers 2*a* and the one or more human side fragmentation resistance layers 2*d*. Similar to the threat side encapsulation layer 1, in one exemplary embodiment, the human side encapsulation layer 3 includes sublayers including a thermal barrier 3*a* adjacent the ballistic protection material layer 2, a foam member 3*b* between the thermal barrier 3*a* and the user, and a skin 3*c* between the foam member 3*b* and the user at an innermost region of the EBPS (i.e. a portion of the EBPS nearest the user, that is the human or object to be protected).

Each component of the EBPS set forth above and depicted in the FIG. 1 is configured to perform a specific function based on user-defined ballistic protection and performance requirements and may include one or more layers of the same or different material(s). As illustrated in the FIG. 1, an exemplary embodiment of an EBPS includes an encapsulated ballistic protection material component (i.e. the ballistic protection material layer 2) which is sandwiched between a threat-side component (i.e. the threat side encapsulation layer 1) and a human-side component (i.e. the human side encapsulation layer 3). The components of the threat side encapsulation layer 1 and the human side encapsulation layer 3 may be the same, or may vary in the number of sublayers, the thickness of the layers and/or sublayers, or in the materials used in each layer and/or sublayer, depending on the type or level of perceived threat. In an exemplary embodiment, the threat side encapsulation layer 1 and the human side encapsulation layer 3 completely encapsulate the ballistic protection material layer 2. The purpose and function, as well as components of construction according to some embodiments, of each layer and sublayer are described in further detail below.

The threat side encapsulation layer 1 serves as an outer layer of a shaped armor system that (1) provides a vapor and/or pathogen barrier; (2) assists in reducing damage to the ballistic protection material layer 2 from initial ballistic impact by absorbing and distributing impact shock, while providing retention of the ballistic protection material of the ballistic protection material layer 2; and (3) assists in reducing projectile fragment ricochet. The threat side is defined as the side of the EBPS that resists the initial point of projectile impact. As such, the threat side is the side of the EBPS distal from and facing away from a user of the EBPS. The threat side encapsulation layer 1, in one embodiment, includes the skin 1*a*, the foam member 1*b*, and/or the thermal barrier 1*c*, as described below.

The skin 1*a* includes one or more layers forming the outermost sublayer of the EBPS panel or structure and provides a vapor and/or pathogen barrier for the ballistic protection material layer 2 on the threat side of the EBPS. The skin 1*a*, in one embodiment, has an external textured surface forming an outer surface of the EBPS panel or structure, which may be further coated with one or more known coatings (e.g., paints, epoxies, etc.) for additional protection from the environment. The skin 1*a* may be integrated with other sublayers of the threat side encapsulation layer 1 or may be a separate overwrap of different material composition. Embodiments of the skin 1*a* may be formed of a thermoplastic polyvinyl chloride (PVC) of approximately 1.00 pounds per square foot, or one or more layers of varying thickness of carbon-carbon, carbon-KEVLAR fiber, KEVLAR, carbon-TWARON, TWARON, carbon-SPECTRA, carbon-S-Glass, carbon E-Glass, or fiberglass with each layer with a specific degree of offset and infused or bonded with WEST SYSTEM® 105/205 epoxy resin with hardener, or any other suitable material(s). WEST SYSTEM is a registered U.S. trademark owned by West System Inc. (Bay City, Mich.).

The foam member 1*b* includes one or more layers forming inner layer(s) (i.e. layer(s) that are closer to the human side or user's body than the skin 1*a*) of the threat side encapsulation layer 1 of the EBPS and is configured to (1) provide retention of ballistic protection material of the ballistic protection material layer 2; (2) provide energy absorption of initial ballistic projectile impact; (3) reduce projectile velocity; and (4) support retention of the threat side encapsulation layer 1. The foam member 1*b* may also be augmented with additional material(s), such as a fibrous material, to enhance the structural performance of the EBPS. Embodiments of the foam member 1*b* may be formed of a closed-cell, linear, thermoplastic foam with extremely high damage tolerance that is cold formable to simple shapes and thermo-formable to complex, three-dimensional curves, and is non-friable, such as 0.125-inch thick Alcan's AIREX® R63 foam. Alternatively, the foam member 1*b* may be formed of any other suitable foam material(s), from one or more layers of compressible material(s) other than foam, or from any combination thereof. AIREX is a registered U.S. trademark owned by Alcan Airex AG (Switzerland).

The thermal barrier 1*c*, in one embodiment, includes one or more insulative layers on the threat side of the EBPS panel or structure to protect the ballistic protection material of the ballistic protection material layer 2 from heat produced from the encapsulation process, if necessary. The thermal barrier 1*c* may include one or more layers of the same or different materials, such as one sheet of 0.024-inch thick KEVLAR 745 weave weighing approximately 0.086 pounds per square foot, or any other suitable material(s).

The ballistic protection material layer 2 is the layer of the EBPS that provides the predominant resistance to ballistic projectile impacts and includes one or more layers of material to meet ballistic impact resistance objectives. The ballistic protection material layer 2, in one embodiment, includes the threat side fragmentation resistance layer(s) 2*a*, the liner 2*b*, the strike face 2*c*, and the human side fragmentation resistance layer(s) 2*d*, as described below.

The threat side fragmentation resistance layer(s) 2*a*, in one embodiment, is the outer sublayer of the ballistic protection material layer 2 and is configured to provide, fragmentation resistance and retention of subsequent layers of the ballistic protection material layer 2. The threat side fragmentation resistance layer(s) 2*a* may in one exemplary embodiment include one or more layers of 0.017-inch thick carbon-carbon fiber weave bonded with epoxy resin, vacuum-bagged to a negative pressure of 27 in-hg and bonded to the threat side encapsulation layer 1, liner 2*b*, or strike face 2*c* using a thermoplastic adhesive. Alternatively, the threat side fragmentation resistance layer(s) 2*a* may be formed of any other suitable material(s).

The liner 2*b* is a material located on at least the threat side of the strike face 2*c*, and in exemplary embodiments, serves as an encasement of the strike face 2*c* alone or as an encasement of the entire primary ballistic protection material layer 2 for retention and resistance to fragmentation. In one exemplary embodiment, as shown in FIG. 1, the liner 2*b* is located on all sides of the strike face 2*c* and encases the strike face 2*c* and the human side fragmentation resistance layer 2*d*. The liner 2*b* may be formed of a bonded rubber or thermoplastic adhesive having a thickness of approximately 3 mm and weighing approximately 0.03 pounds per square foot, or any other suitable material(s) and may be bonded to the strike face 2*c* and/or the human side fragmentation resistance layer 2*d* using a bonding agent, such as a resin or a glue.

The strike face 2*c* is a material used and configured for providing the initial projectile ballistic impact resistance, as well as for altering the projectile trajectory and maximizing fragmentation of the projectile. The strike face 2*c* also offers protection against stabbing knife blows, arrows, ice picks, other sharp objects, and bullets manufactured of non-deformable materials, such as those with a hardened core instead of lead (also known as armor piercing rounds). The strike face 2*c* may be formed in one exemplary embodiment of one or more aluminum oxide, boron carbide, and/or silicon carbide tiles, 1.00-inch long by 1.00-inch wide by 0.6-inch thick, weighing approximately 0.06 pounds each, for example, or any other suitable material(s). Further, multiple layers of the same or different materials may be used to meet various threat requirements, offsetting joints for subsequent layers. In one embodiment, layers of the strike face 2*c* may be separated by thermoplastic foam.

The human side fragmentation resistance layer(s) 2*d* is the inner sublayer of the ballistic protection material layer 2 and is configured to provide fragmentation resistance and retention of projectile fragments and/or of the other sublayers of the ballistic protection material layer 2. The human side fragmentation resistance layer(s) 2*d* may in one exemplary embodiment include one or more layers of 0.012-inch thick carbon-carbon fiber weave bonded with epoxy resin, one or more layers of 0.009-inch thick Honeywell SPECTRA SR 3124, and/or one or more layers of 0.009-inch thick DYNEEMA HB 31, each layer with a degree of offset to a varying thickness of 0.25 inches, vacuum-bagged to a negative pressure of 27 in-hg or hot pressed, and bonded to the strike face 2*c* and human side encapsulation layer 3 using a thermoplastic adhesive, polysulfide adhesive, epoxy resin systems, melamine, or other suitable bonding adhesive or resin. Alternatively, the human side fragmentation resistance layer(s) 2*d* may be formed of any other suitable material(s).

Further, according to an exemplary embodiment, as shown in FIG. 1, the EBPS further includes one or more compressible layers 2*e* between the human side fragmentation resistance layer(s) 2*d* and the human side encapsulation layer 3. Although the compressible layer 2*e* is shown in FIG. 1 as being located outside of the liner 2*b*, in another embodiment, the compressible layer 2*e* may be located inside the liner 2*b*, that is, between the human side fragmentation resistance layer(s) 2*d* and the liner 2*b*. The compressible layer 2*e*, in one exemplary embodiment, is formed of a foam material, but alternatively may be formed of particle board, a fibrous material, or any other suitable compressible material or combination of materials. For example, the compressible layer 2*e* may be formed of hard board foam, such as AIREX R63.8, AIREX R63.5, AIREX R63.140, STEPFOAM P-502, P-510, P-525, or a customized mixture; honeycomb material or honeycomb composite, such as thermoplastic honeycomb, KEVLAR/PHENOLIC honeycomb, NOMEX/PHENOLIC honeycomb, HJI PHENOLIC honeycomb, Polystrand/PHENOLIC honeycomb, HEXCEL, HEXWEB Microcell CR3, HEXWEB FLEXCORE, HEXWEB HRH 49, HEXWEB RIGIDCELL, Aluminum Paper Honeycomb 10.0-⅛-25(5052)T, 12.0-⅛-30(5052)T, 3.9-½-40(5052)T, 1.8-¾-25(5052)T, or KEVLAR Paper Honeycomb HRH36-3/16-6.0; rubber compounds, such as Smooth-on Polysulfide or Smooth-on Urethane, or any other suitable material.

The compressible layer 2*e*, in exemplary embodiments, is configured to allow some deformation of ballistic protection material of the ballistic protection material layer 2 and thereby assist in dissipation of energy, reduction of projectile velocity, capture, retention, and/or reflection of projectile fragments, while minimizing or reducing backface signature. Moreover, in exemplary embodiments of the EBPS, the compressive property of the compressible layer 2*e* complements the structural properties of the human side encapsulation layer 3 to provide a pillowing or trampoline effect for dissipation of energy of the projectile. This energy dissipation effect is evident and critical in an exemplary embodiment in which the ballistic protection material layer 2 is substantially or completely encapsulated by the threat side and human side encapsulation layers 1, 3. Also, in one exemplary embodiment, the EBPS includes a hardened foam layer behind the strike face 2*c* further providing compression resistance and retention of the strike face 2*c*.

The human side encapsulation layer 3 serves as an inner layer of a shaped armor system that provides a vapor and pathogen barrier and retention of ballistic protection material of the ballistic protection material layer 2. The human side is defined as the side of the EBPS panel or structure that is closest to the human source requiring protection. As such, the human side is the side of the EBPS proximate and facing toward the user of the EBPS. The human side encapsulation layer 3, in one embodiment, includes the thermal barrier 3*a*, the foam member 3*b*, and the skin 3*c*, as described below.

The thermal barrier 3*a*, in one embodiment, includes one or more insulative layers on the human side of the EBPS to protect the ballistic protection material of the ballistic protection material layer 2 from heat produced by the encapsulation process used for encapsulating the ballistic protection material layer 2 with the human side encapsulation layer 3. The thermal barrier 3*a* may in one exemplary embodiment include one or more layers of the same or different materials, such as one sheet of 0.012-inch thick KEVLAR 745 weave weighing approximately 0.086 pounds per square foot, or any other suitable material(s).

The foam member 3*b* includes one or more layers of foam for providing an energy dissipative function and retention of ballistic protection material of the ballistic protection material layer 2. The foam member 3*b*, in one embodiment, is also configured to permit some deformation of ballistic protection material of the ballistic protection material layer 2 to assist in dissipation of energy, reduction of projectile velocity, capture, retention, and/or reflection of projectile fragments, while minimizing or reducing backface signature. In particular, in an exemplary embodiment of the EBPS, the foam member 3*b* is configured to complement the structural properties of the human side encapsulation layer 3. The foam member 3*b* may also be augmented with additional material(s) to enhance the structural performance of the EBPS. Exemplary embodiments of the foam member 3*b* may be formed of a closed-cell, linear, thermoplastic foam with extremely high damage tolerance that is cold formable to simple shapes and thermo-formable to complex, three-dimensional curves, and is non-friable, such as 0.125-inch thick Alcan's AIREX® R63 foam. Alternatively, the foam member 3*b* may be formed of any other suitable foam material(s), from one or more layers of compressible material(s) other than foam, or from any combination thereof. Further, in one embodiment, the foam member 3*b* is bonded to the skin 3*c* using WEST SYSTEM® 105/205 epoxy resin with hardener.

The skin 3*c* includes one or more layers for providing a vapor and pathogen barrier for the ballistic protection material layer 2 from the human side of the EBPS. The skin 3*c*, in one exemplary embodiment, is coated with one or more suitable materials for additional protection from the environment. The skin 3*c* may be integrated with other sublayers of the human side encapsulation layer 3 or may be a separate overwrap of a different material composition. Embodiments of the skin 3*c* may be formed of a thermoplastic polyvinyl chloride (PVC) of approximately 1.00 pounds per square foot, or one or more layers of varying thickness of carbon-carbon, carbon-KEVLAR fiber, KEVLAR, carbon-TWARON, TWARON, carbon-SPECTRA, carbon-S-Glass, carbon E-Glass, or fiberglass with each layer with a specific degree of offset and infused or bonded with WEST SYSTEM® 105/205 epoxy resin with hardener, or any other suitable material(s).

Embodiments of an EBPS according to the present invention include a combination of some or all of the layers and sublayers described above to form a novel layered material composition approach to resist ballistic and/or blast impact. The described layered composition effectively alters the trajectory of a projectile, redistributes the directional force of impact, dissipates the impact energy and velocity of a projectile, and reflects the energy and fragments of the projectile back in a direction opposite the direction of impact to effectively eliminate complete penetration through the armor system and minimize backface signature. Each layer performs a different function to contribute to the overall ballistic resistance capability of the EBPS.

To illustrate the present invention, the following description traces the path and behavior of a projectile as it impacts and interfaces with the various layered components of the EBPS illustrated in the FIG. 1, the components of which are described above. As a projectile impacts the threat side encapsulation layer 1, it penetrates each of the threat side encapsulation layer 1, the threat side fragmentation resistance layer 2*a*, and the liner 2*b* (if any) with some, but not significant, energy dissipation until it impacts the strike face 2*c*. As described above, the strike face 2*c* in an exemplary embodiment includes a single layer or multiple layers of the same or different dense material(s), such as silicon carbide (SiC), which receives a significant portion of the initial impact energy, resulting in fragmentation of the first, and perhaps subsequent layers (if any) of the strike face 2*c*. Several phenomena occur as a result of the projectile impact to alter its behavior. First, the projectile is met by resistance which dissipates a significant portion of the impact energy (the specific amount of energy dissipated varies by projectile type, velocity, mass, direction of impact, and other factors). Second, the mass of the projectile is changed, and third, the trajectory of the projectile is altered as a result of both the fragmentation of the strike face 2*c* material and the deformation, degradation, and/or failure of the projectile material itself.

The integrity and retention of the strike face 2*c* material is assisted and retrained, at least partially, even after fragmentation from projectile impact, by both the liner 2*b* (if included in the embodiment) and the threat side and human side fragmentation resistance layers 2*a*, 2*d*, thereby assisting the EBPS to more effectively resist subsequent impacts from additional projectiles.

As the projectile and/or projectile fragments progress through the strike face 2*c* into the human side fragmentation resistance layer 2*d*, they encounter a less dense, fibrous material composition that yields and stretches, captures, further reduces the velocity, retains, and even reflects the projectile or projectile fragments before fully penetrating the EBPS. The compressible layer 2*e* and/or the foam member 3*b* of the human side encapsulation layer 3 permit the deformation or stretching of the fibrous human side fragmentation resistance layer 2*d* which assists the material in enhancing its ability to capture, further reduce the velocity, retain, and reflect the projectile or projectile fragments and reduce backface signature. This allows the EBPS to behave like NxRA (Non-Explosive Reactive Armor) by permitting the human side fragmentation resistance layer 2*d* to create a "trampoline" or pillowing effect which provides energy dissipation and sufficient resistance to slow the velocity of the projectile or projectile fragments to zero as the fibrous materials are stretched and to reflect the projectile or projectile fragments back in a direction opposite the direction of the projectile impact as material of subsequent layers of the un-penetrated fibrous human side fragmentation resistance layer 2*d* rebounds.

The threat side and human side encapsulation layers 1, 3 significantly enhance the overall ballistic resistance capability of the EBPS. Complete encapsulation by the threat side and human side encapsulation layers 1, 3 provides restraint, without overly constraining the fibrous components of the human side fragmentation resistance layer 2*d*, which is critical in maximizing the retention and reflection properties of the human side fragmentation resistance layer 2*d*. Encapsulation further adapts the EBPS to retain more material in place to further restrain the projectile or projectile fragments from penetrating the EBPS, minimize backface signature, and enhance the ability of the EBPS to resist subsequent projectile impact(s). The EBPS, in some embodiments, uses resins to permit the fibers to stretch and deform to minimize shear failure of the fibers, unlike other typical hard resin impregnated fibrous materials. This permits the EBPS system to yield; absorb and dissipate projectile impact energy and enhance the system in maintaining the structural and ballistic retention properties of the EBPS layers; retain projectile fragments; and minimize the backface signature.

The encapsulation layers and sublayered component configurations of embodiments of an EBPS of the present invention also permit the EBPS to distribute and disperse the energy from projectile impact over a larger surface area, the benefit of which is reflected in a reduced backface signature. Exemplary embodiments of an EBPS of the present invention may be formed using known methods, such as lay-up or vacuum bag methods. Layers may be adhered to each other and/or other layer(s) using a thermoplastic adhesive film, polysulfide adhesive glue, or a resin system matrix as binder materials or may be stacked un-bonded. Further, in an exemplary embodiment of the EBPS, the EBPS is formed by first wrapping layers around the outer edges of the faces or plates of the EBPS, and subsequently overlapping layers across the faces.

In one exemplary embodiment, one or both of the threat side and human side encapsulation layers 1, 3 may include one or more pressure relief points for releasing pressure or preventing pressure from building inside the encapsulated structure of the EBPS. For example, in one embodiment, a series of holes, ports, plugs, and/or valves, such as 0.25-inch diameter holes, are formed through the human side encapsulation layer 3. In one embodiment, a series of vent holes, ports, plugs, and/or valves may be formed at substantially regular intervals in the encapsulation layer. In other embodiments, vent holes may be formed having any suitable size, shape, or pattern, and at any suitable location on the EBPS. It is noted that embodiments of an EBPS according to the present invention which have vent holes, or other small openings, through one or more of the encapsulation layers may be described as being "substantially encapsulated" since there is not a complete encapsulation of the ballistic protection material of the ballistic protection material layer 2.

Embodiments of an EBPS according to the present invention may further include and incorporate one or more sensors 4 adapted to detect, measure, and/or report an impact on the EBPS. The one or more sensors 4 may include, but are not limited to, load sensors to indicate force of impact on the EBPS, sensors to indicate integrity breach to the EBPS, sensors to indicate physical location of the EBPS, biological signatures, such as heart rate monitors, to monitor the health of an individual, chemical-biological-nuclear detection sensors, and/or other sensors to characterize and report the status or viability of the EBPS. The one or more sensors 4, in one embodiment, are embedded in the EBPS, as shown in FIGS. 1 and 2, and are configured to transmit, through wired or wireless communications, to a communications module within, near, or distant from the armor that sends sensor data or an alert wirelessly to a central operations command for appropriate response.

Figure 3:
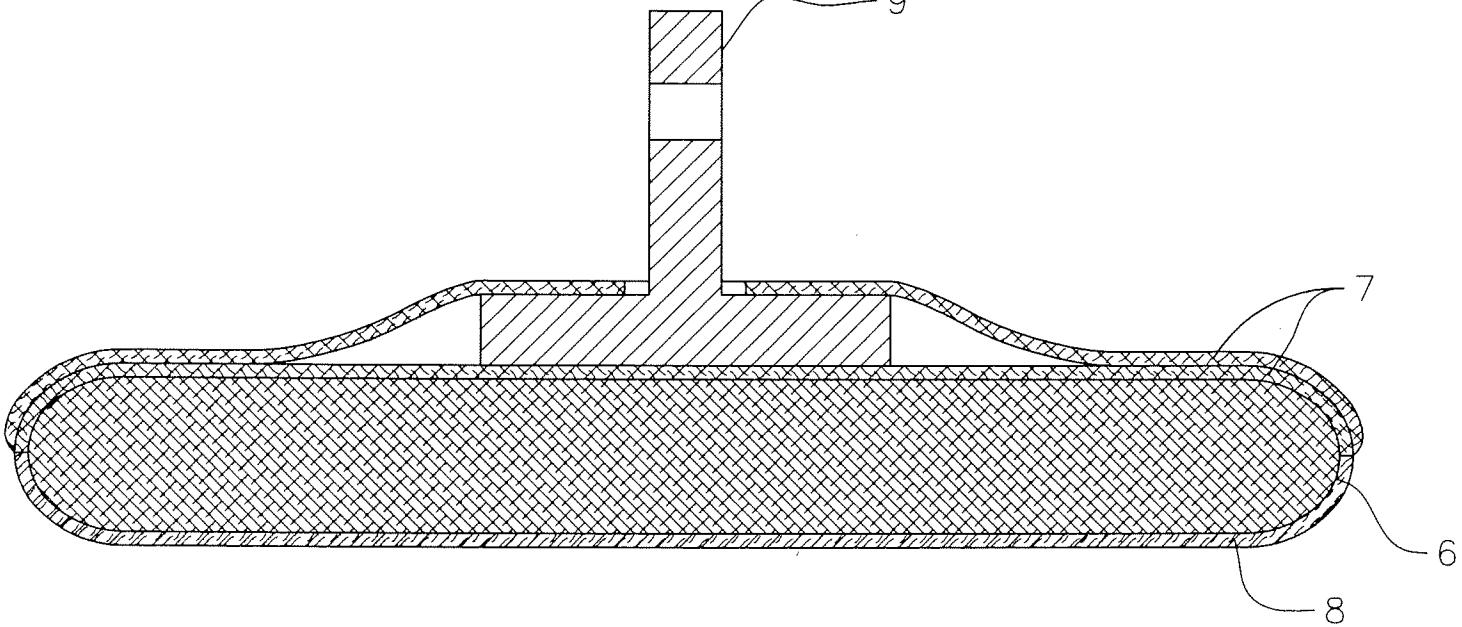
FIG. 3 is a schematic cross-sectional view of an encapsulated ballistic protection system according to another embodiment of the present invention.

Embodiments of an EBPS according to the present invention enable any structure, such as structural members for buildings, vehicles, aircraft, watercraft, etc., to be integrated with armor to create "structural armor." Since the encapsulation materials can be formed and/or molded into virtually any shape or configuration and the materials can encase structural members within the layered components, embodiments of the present invention enable the coupling of structure and armor into a total system solution instead of being parasitically-applied, as in other armor systems. For example, the encapsulation material itself can be formed and/or molded into channels, beams, bracing, etc., acting as structural members themselves or the EBPS can be formed around structural components integrating them within the EBPS, as shown in FIG. 3. In one exemplary embodiment, the encapsulation layer has a tensile strength of at least 20,000 psi.

With reference to FIG. 3, an EBPS according to an exemplary embodiment of the present invention includes a ballistic protection material layer 6, similar or the same as that described above with respect to the ballistic protection material layer 2, and at least one encapsulation layer on one or both sides of the ballistic protection material layer 6. For example, in one exemplary embodiment as shown in FIG. 3, the EBPS includes a first encapsulation layer 7 adjacent the ballistic protection material layer 6 on a first side and a second encapsulation layer 8 adjacent the ballistic protection material layer 6 on a second side opposite the first side. The first and second encapsulation layers 7 and 8, in one embodiment, are the same or similar to the threat side encapsulation layer 1 and the human side encapsulation layer 3, respectively, described above and may include one or more of the sublayers described therewith. Additionally, the EBPS of FIG. 3 incorporates one or more structural members 9 at least partially embedded in at least one of the first and second encapsulation layers 7 and 8. Also, while the structural member 9 shown in FIG. 3 is partially embedded between two sublayers of the first encapsulation layer 7, in another embodiment of an EBPS of the present invention, the structural member 9 may be at least partially embedded between the first encapsulation layer 7 and the ballistic protection material layer 6 itself. Further, in another embodiment, the structural member 9 may be at least partially embedded between the second encapsulation layer 8 and the ballistic protection material layer 6 or between sublayers of the second encapsulation layer 8. The structural member 9 may be a structural angle, I-beam, or any other suitable structural component.

Figure 4:
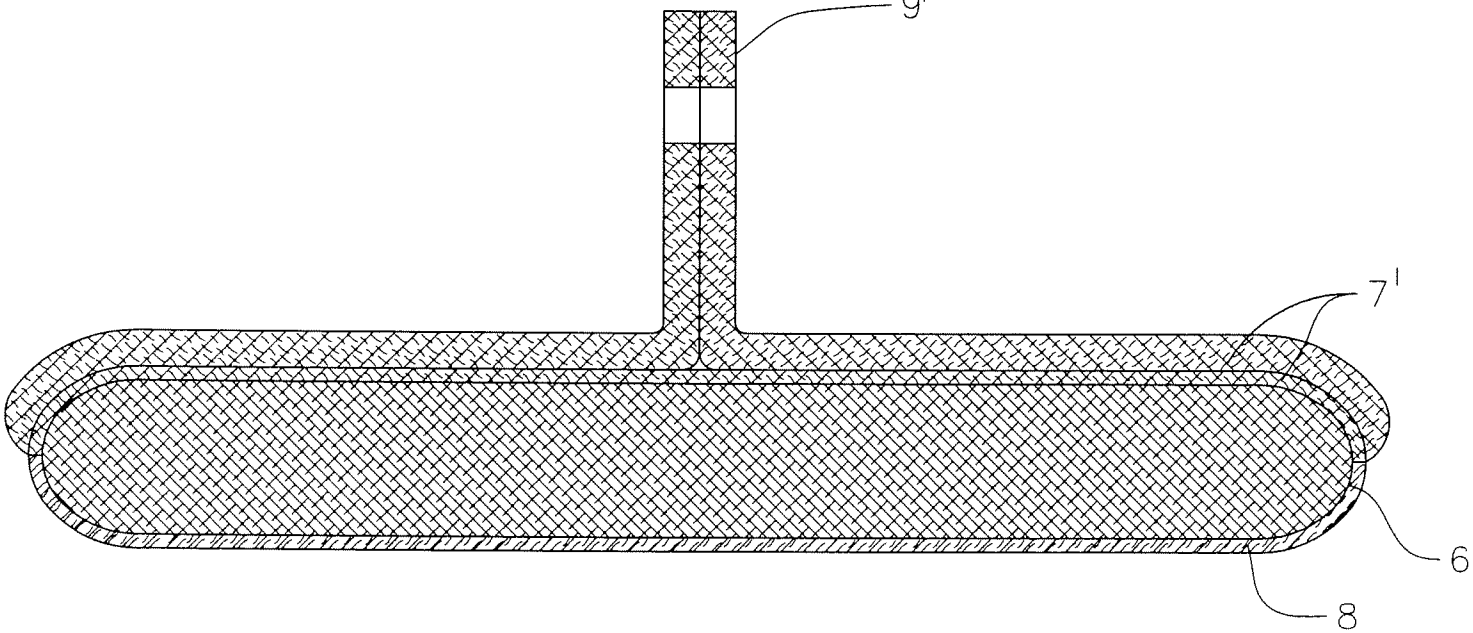
FIG. 4 is a schematic cross-sectional view of an encapsulated ballistic protection system according to another embodiment of the present invention.

Further, while in the embodiment described above, the structural member 9 is a member that is initially separate and is integrated into the EBPS by at least partially embedding the structural member 9 in the encapsulation layer, in another embodiment of an EBPS according to the present invention, as shown in FIG. 4, one or more structural members 9' may be formed or shaped from the encapsulation material itself. For example, the skin of the encapsulation layer may be formed into any desired structural shape or structural member. As illustrated in FIG. 4, in one embodiment, a first encapsulation layer 7' is formed into the shape of the structural member 9'. However, in another embodiment, one or more structural members 9' may be formed from material of the second encapsulation layer 8, alternatively or in addition to the one or more structural members 9' formed from material of the first encapsulation layer 7'.

Further, the structural member 9, in an exemplary embodiment, is coupleable to another structure (e.g., a vehicle, building, or other object to be protected) via fasteners, welding, or any other suitable device. In other words, an EBPS according to an exemplary embodiment of the present invention may be used to form structural components which are themselves inherently structural armor or may be used to form structural armor on existing structural components. Either approach provides "structural armor."

The following table contains several exemplary layer configurations of embodiments of an EBPS of the present invention for meeting identified threat levels. These configurations are representative of various embodiments of the type, specification, quantity, dimension, and other characteristics for meeting the purpose of each identified EBPS layer and are not intended to represent the only possible embodiments of the present invention that will meet the identified threat levels or the only threat levels applicable.

TABLE 1

Exemplary EBPS Configurations

| EBPS Layer | NIJ Type IIIA | NIJ Type IV | NIJ Special Type (20 mm FSP Round) |
|---|---|---|---|
| 1. Encapsulation—Threat Side | | | |
| 1a. Skin—Threat Side | 4 Layers 2× of Carbon-Carbon 0, 90°; 2 layers of Carbon-KEVLAR twill 0, 90° Each layer is 0.068" thick | 4 Layers 2× of Carbon-Carbon 0, 90°; 2 layers of Carbon-KEVLAR twill 0, 90° Each layer is 0.068" thick | 4 Layers 2× of Carbon-Carbon 0, 90°; 2 layers of Carbon-KEVLAR twill 0, 90° Each layer is 0.068" thick |
| 1b. Foam—Threat Side | 0.125" thick AIREX ® R63.80 foam | 0.125" thick AIREX ® R63.80 foam | 0.500" thick AIREX ® R63.80 foam |
| 1c. Thermal Barrier—Threat Side | N/A | N/A | N/A |
| 2. Ballistic Protection Material | | | |
| 2a. Fragmentation Resistance Layer(s)—Threat Side | N/A | 2 layers of 0.017" thick Carbon-Carbon weave, bonded with WEST SYSTEM ® 105/205 epoxy resin with hardener. Layers are vacuum-bagged to a negative pressure of 27 inch hg. Bonded to Strike Face using thermoplastic adhesive. | N/A |
| 2b. Liner | N/A | Thermoplastic adhesive 3 mm thick, 0.03 lbs. per sq ft. | 2 layers of 0.017" thick Carbon-Carbon weave bonded with WEST SYSTEM ® 105/205 epoxy resin with hardener. Liner material completely encases the Strike Face material. Layers are vacuum-bagged to a negative pressure of 27 inch hg. Bonded to Strike |

TABLE 1-continued

| Exemplary EBPS Configurations | | | |
|---|---|---|---|
| EBPS Layer | NIJ Type IIIA | NIJ Type IV | NIJ Special Type (20 mm FSP Round) |
| | | | Face using thermoplastic adhesive. |
| 2c. Strike Face | N/A | Silicon Carbide, 1.00" long × 1.00" wide × 0.6" thick tiles, weighing 0.06 pounds each | Silicon Carbide, 1.00" long × 0.6" wide × 1.00" thick tiles, weighing 0.06 pounds each |
| 2d. Fragmentation Resistance Layer(s)—Human Side | 20 layers of 0.022" thick KEVLAR 745 cloth, weighing 0.086 lbs per layer, hot pressed. | 2 layers of 0.017" thick Carbon-Carbon weave bonded with WEST SYSTEM ® 105/205 epoxy resin with hardener. Layers are vacuum-bagged to a negative pressure of 27 inch hg. Bonded to Strike Face using thermoplastic adhesive. 2 layers of HONEYWELL SPECTRA 3124, (each layer consists of 11 layers of 0.009 thick cloth), hot pressed to 0.25" total per layer. | 0.125" thick AIREX ® R63.80 foam adhered to the Liner using thermoplastic adhesive. 6 Layers of pre-manufactured, 0.25" thick DYNEEMA HB 31, weighing 1.1 lbs per sq ft, per layer. DYNEEMA layers pressure bonded only. |
| 2e. Compressible Layer | Hard board foams, honeycomb materials, and/or rubber compounds | Hard board foams, honeycomb materials, and/or rubber compounds | Hard board foams, honeycomb materials, and/or rubber compounds |
| 3. Encapsulation—Human Side | | | |
| 3a. Thermal Barrier—Human Side | N/A | N/A | N/A |
| 3b. Foam—Human Side | 0.125" thick AIREX ® R63.80 foam | 0.125" thick AIREX ® R63.80 foam bonded to Skin with WEST SYSTEM ® 105/205 epoxy resin with hardener. | 0.500" thick AIREX ® R63.80 foam bonded to Skin with WEST SYSTEM ® 105/205 epoxy resin with hardener. |
| 3c. Skin—Human Side | 4 Layers 2× of Carbon-Carbon 0, 90°; 2 layers of Carbon-KEVLAR twill 0, 90° Each layer is 0.068" thick | 4 Layers 2× of Carbon-Carbon 0, 90°; 2 layers of Carbon-KEVLAR twill 0, 90° Each layer is 0.068" thick | 4 Layers 2× of Carbon-Carbon 0, 90°; 2 layers of Carbon-KEVLAR twill 0, 90° Each layer is 0.068" thick |
| Performance | Resisted 5 impacts of 124 gr, 9 mm, FMJ at 1400 ft/sec +/− 50 ft/sec, at a distance of 16 feet in 16 square inch area, with no observable backface signature. | Resisted 2 impacts of 7.62 × 63 mm APM2 at 2850 ft/sec +/− 50 ft/sec, at a distance of 49.6 feet, 4" between impacts, with less than 20 mm of backface deformation. | Resisted 20 mm Fragmented Simulated Projectile (FSP) impact at 4200 ft/sec at 49.6 ft. Panel was heavily damaged but remained intact. Conforms to MIL-STD 662F for fragmentation. |

Although the drawings and accompanying description illustrate an embodiment of an encapsulated ballistic protection system, it will be apparent that the novel aspects of the encapsulated ballistic protection system of the invention may also be carried out by utilizing alternative structures, sizes, shapes, and/or materials in embodiments of the encapsulated ballistic protection system of the present invention. For example, according to some embodiments of an EBPS of the present invention, one or more of the layers or sublayers described above may be absent. Further, for example, in some embodiments, layers or sublayers of the EBPS may be layered according to a different sequence than described above and shown in the accompanying drawings. Embodiments of the encapsulated ballistic protection system may also, for example, be adapted for use by various market sectors.

The preceding description has been presented with reference to various embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. An encapsulated ballistic protection system (EBPS) for protecting a human or an object from a projectile, the EBPS comprising one or more ballistic protection material layers at least substantially encapsulated by encapsulation material having a tensile strength of 20,000 psi or greater, wherein the one or more ballistic protection material layers are substantially encapsulated by the encapsulation material on a first side adapted to face the human or the object and on a second side opposite the first side and adapted to face the projectile, and the EBPS further comprises a compressible layer between the one or more ballistic protection material layers and the encapsulation material on the first side, the compressible layer configured to at least one of dissipate energy, reduce velocity of the projectile, and reduce backface deformation, and wherein the one or more ballistic protection material layers comprise, a strike face configured to resist the projectile, a fragmentation resistance layer adjacent the strike face and configured to resist fragmentation of the strike face and retain the strike face and the projectile, and a liner encasing at least the strike face and configured to retain and resist fragmentation of the strike face, wherein the encapsulation material comprises a first encapsulation layer on the first side of the one or more ballistic protection material layers, and a second encapsulation layer on the second side of the one or more ballistic protection material layers, wherein the fragmentation resistance layer is between the first encapsulation layer and the strike face, and wherein the first and second encapsulation layers are integrated with each other and together encapsulate the one or more ballistic protection material layers.

2. The EBPS of claim 1, wherein the compressible layer comprises at least one material selected from the group consisting of hard board foams, honeycomb materials, and rubber compounds.

3. The EBPS of claim 1, wherein the encapsulation material comprises at least one material selected from the group consisting of carbon-carbon, carbon-KEVLAR, KEVLAR, carbon-TWARON, TWARON, carbon-SPECTRA, carbon-S-Glass, carbon E-Glass, and fiberglass.

4. The EBPS of claim 3, wherein the first encapsulation layer comprises a different material than the second encapsulation layer.

5. The EBPS of claim 1, wherein the first encapsulation layer has a different thickness than the second encapsulation layer.

6. The EBPS of claim 1, wherein the first encapsulation layer comprises a different material than the second encapsulation layer.

7. The EBPS of claim 1, wherein the fragmentation resistance layer is a first fragmentation resistance layer, and the EBPS further comprises a second fragmentation resistance layer between the second encapsulation layer and the strike face, the second fragmentation resistance layer configured to resist fragmentation of the strike face and retain the strike face and the projectile, wherein the strike face is sandwiched between the first and second fragmentation resistance layers.

8. The EBPS of claim 1, wherein the first encapsulation layer comprises a first foam member configured to at least one of dissipate energy, reduce velocity of the projectile, and reduce backface deformation.

9. The EBPS of claim 8, wherein the fragmentation resistance layer is deformable against at least one of the compressible layer and the first foam member for at least one of dissipating energy, reducing velocity of the projectile, and reducing backface deformation.

10. The EBPS of claim 9, wherein the second encapsulation layer comprises a second foam member, a second thermal barrier between the second foam layer and the one or more ballistic protection material layers, and a second outer skin on a side of the second foam member opposite the second thermal barrier.

11. The EBPS of claim 8, wherein the first encapsulation layer further comprises a first thermal barrier between the first foam member and the one or more ballistic protection material layers, and a first outer skin on a side of the first foam member opposite the first thermal barrier.

12. The EBPS of claim 1, wherein the strike face comprises at least one material selected from the group consisting of aluminum oxide, boron carbide, silicon carbide, and other hardened composites.

13. The EBPS of claim 1, wherein the strike face comprises a plurality of tiles and at least one of a thermoplastic film and a bonding agent between and joining tiles of the plurality of tiles to one another.

14. The EBPS of claim 1, wherein the liner comprises at least one material selected from the group consisting of a rubber, a thermoplastic material, a fibrous material, a resin, and a glue.

15. The EBPS of claim 1, wherein the liner encases the fragmentation resistance layer.

16. The EBPS of claim 1, wherein the fragmentation resistance layer comprises a woven fibrous material.

17. The EBPS of claim 1, further comprising at least one sensor of the group of sensors consisting of: sensors adapted to at least one of detect, measure, assess, and report at least one of an impact of the projectile on the EBPS, an integrity breach to the EBPS, and a physical location of the EBPS; biological life signature sensors for monitoring health of the human; chemical-biological-nuclear detection sensors; and sensors adapted to at least one of characterize and report a status of the EBPS.

18. The EBPS of claim 1, further comprising at least one structural member at least partially embedded in the encapsulation material.

19. The EBPS of claim 1, further comprising at least one structural member formed from the encapsulation material.

20. The EBPS of claim 1, wherein the one or more ballistic protection material layers are completely encapsulated by the encapsulation material.

21. The EBPS of claim 1, wherein the encapsulation material has one or more pressure relief points for at least one of releasing pressure and reducing pressure build-up in the EBPS.

22. An encapsulated ballistic protection system (EBPS) for protecting a human or an object from a projectile, the EBPS comprising one or more ballistic protection material layers at least substantially encapsulated by encapsulation material having a tensile strength of 20,000 psi or greater, wherein the one or more ballistic protection material layers comprise, a strike face configured to resist the projectile, a fragmentation resistance layer adjacent the strike face and configured to resist fragmentation of the strike face and retain the strike face and the projectile, and a liner encasing at least the strike face and configured to retain and resist fragmentation of the strike face, wherein the encapsulation material comprises a first encapsulation layer on the first side of the one or more ballistic protection material layers, and a second encapsulation layer on the second side of the one or more ballistic protection material layers, wherein the fragmentation resistance layer is between the first encapsulation layer and the strike face, and wherein the first and second encapsulation layers are integrated with each other and together encapsulate the one or more ballistic protection material layers.

23. The EBPS of claim 22, wherein the encapsulation material comprises at least one material selected from the group consisting of carbon-carbon, carbon-KEVLAR, KEVLAR, carbon-TWARON, TWARON, carbon-SPECTRA, carbon-S-Glass, carbon E-Glass, and fiberglass.

24. The EBPS of claim 22, wherein the fragmentation resistance layer is a first fragmentation resistance layer, and the EBPS further comprises a second fragmentation resistance layer between the second encapsulation layer and the strike face, the second fragmentation resistance layer configured to resist fragmentation of the strike face and retain the strike face and the projectile, wherein the strike face is sandwiched between the first and second fragmentation resistance layers.

25. The EBPS of claim 22, wherein the first encapsulation layer comprises a first foam member configured to at least one of dissipate energy, reduce velocity of the projectile, and reduce backface deformation.

26. The EBPS of claim 22, wherein the strike face comprises at least one material selected from the group consisting of aluminum oxide, boron carbide, silicon carbide, and other hardened composites.

27. The EBPS of claim 22, further comprising at least one sensor of the group of sensors consisting of: sensors adapted to at least one of detect, measure, assess, and report at least one of an impact of the projectile on the EBPS, an integrity breach to the EBPS, and a physical location of the EBPS; biological life signature sensors for monitoring health of the human; chemical-biological-nuclear detection sensors; and sensors adapted to at least one of characterize and report a status of the EBPS.

28. The EBPS of claim 22, further comprising at least one structural member at least partially embedded in the encapsulation material.

29. The EBPS of claim 22, further comprising at least one structural member formed from the encapsulation material.

30. The EBPS of claim 22, wherein the one or more ballistic protection material layers are completely encapsulated by the encapsulation material.

31. The EBPS of claim 22, wherein the encapsulation material has one or more pressure relief points for at least one of releasing pressure and reducing pressure build-up in the EBPS.

* * * * *